US011014054B2

(12) United States Patent
Prociw et al.

(10) Patent No.: US 11,014,054 B2
(45) Date of Patent: May 25, 2021

(54) FLUID-GAS MIXER

(71) Applicant: Delavan Inc., West Des Moines, IA (US)

(72) Inventors: Lev Alexander Prociw, Johnston, IA (US); Jason Ryon, Carlisle, IA (US); Philip E. O. Buelow, West Des Moines, IA (US); Brandon Phillip Williams, Johnston, IA (US)

(73) Assignee: Delavan Inc., West Des Moines, IA (US)

( * ) Notice: Subject to any disclaimer, the term of this patent is extended or adjusted under 35 U.S.C. 154(b) by 55 days.

(21) Appl. No.: 16/387,153

(22) Filed: Apr. 17, 2019

(65) Prior Publication Data

US 2020/0332998 A1 Oct. 22, 2020

(51) Int. Cl.

| | |
|---|---|
| ***B01F 5/04*** | (2006.01) |
| ***F23D 11/10*** | (2006.01) |
| ***F23R 3/28*** | (2006.01) |
| ***F23R 3/32*** | (2006.01) |

(52) U.S. Cl.

CPC ..... *B01F 5/0471* (2013.01); *F23D 11/107* (2013.01); *F23R 3/286* (2013.01); *F23R 3/32* (2013.01); *F23D 2900/11101* (2013.01)

(58) Field of Classification Search

CPC .. B01F 3/04; B01F 5/04; B01F 5/0471; B01F 5/06

See application file for complete search history.

(56) References Cited

U.S. PATENT DOCUMENTS

| | | | | |
|---|---|---|---|---|
| 2,398,766 | A | 4/1946 | Bergesen et al. | |
| 3,741,484 | A * | 6/1973 | Cresswell | F23D 11/34 239/424 |
| 4,027,858 | A | 6/1977 | Dettmer | |
| 6,491,064 | B2 * | 12/2002 | Kampe | B01F 3/0446 137/888 |
| 7,434,401 | B2 | 10/2008 | Hayashi | |
| 7,926,282 | B2 | 4/2011 | Chew et al. | |

FOREIGN PATENT DOCUMENTS

| | | |
|---|---|---|
| FR | 1491215 A | 8/1967 |
| WO | 06038810 A1 | 4/2006 |

OTHER PUBLICATIONS

Partial European Search Report dated Jun. 26, 2020, issued during the prosecution of European Patent Application No. 19210636.7. Extended European search report issued in corresponding EP application No. 19210636.7, dated Oct. 1, 2020.

* cited by examiner

*Primary Examiner* — Robert A Hopkins

(74) *Attorney, Agent, or Firm* — Locke Lord LLP; Scott D. Wofsy; Georgi Korobanov

(57) ABSTRACT

A fluid-gas mixer including a housing, defining a primary axis, for mixing fluid and gas, a mixer nozzle circumscribing the primary axis, wherein an annular gap between an outer surface of the mixer nozzle and an inner surface of the housing defines at least one outer gas path, a swirling gas passage defining an inner gas path for mixing with the outer gas path.

13 Claims, 3 Drawing Sheets

Fig. 1
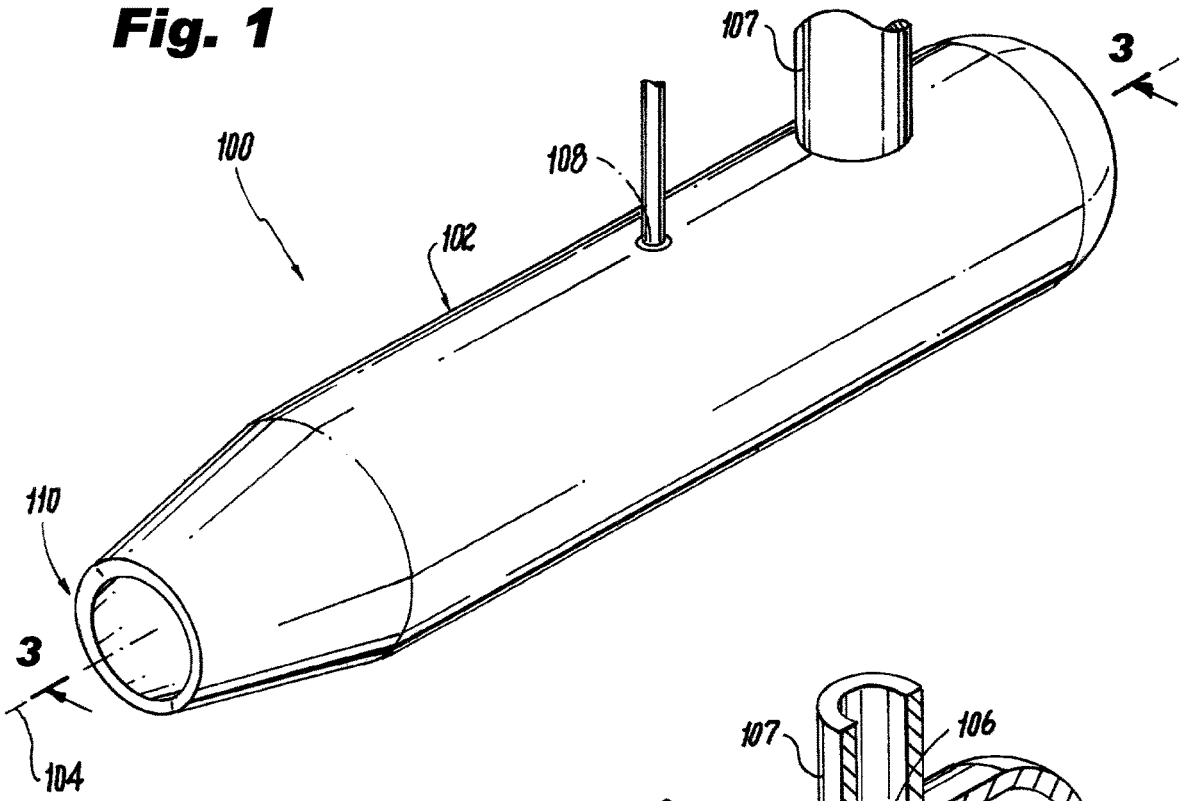
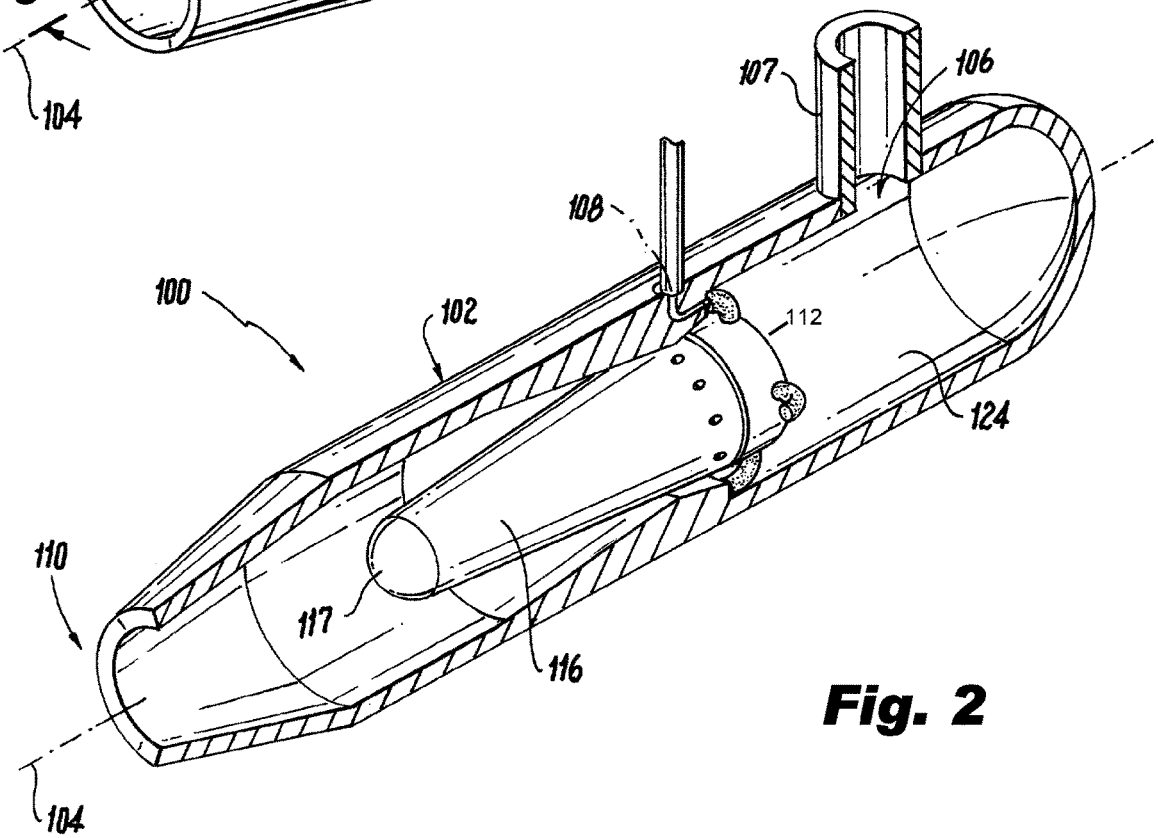
Fig. 2

FLUID-GAS MIXER

BACKGROUND

Technological Field

The present disclosure relates to a fluid-gas mixer, and more particularly to a fluid-gas mixer having an aerated injector with a large diameter.

Description of Related Art

A variety of devices and process are known for mixing a gas such as air and a fluid such as water, oil, paint and various chemicals such as pesticides, herbicides etc. Factors such as fluid viscosity and density may make mixing difficult. Thorough mixing when very small quantities of fluid are required also poses problems. Legacy devices such as pressure atomizing nozzles have difficulty in achieving results required.

The conventional methods and systems have generally been considered satisfactory for their intended purpose. However, there is still a need in the art for fluid-gas mixers having improved performance. There also remains a need in the art for such systems and components that are economically viable. The present disclosure may provide a solution for at least one of these remaining challenges.

SUMMARY OF THE INVENTION

A fluid-gas mixer includes a housing, defining a primary axis, for mixing fluid and gas, a mixer nozzle circumscribing the primary axis, wherein an annular gap between an outer surface of the mixer nozzle and an inner surface of the housing defines at least one outer gas path, an inner gas passage defining an inner gas path for mixing with the outer gas path, a gas conduit connected to the housing for admitting a gas to the inner gas path and to the outer gas path, and a fluid conduit connected to the mixer nozzle.

The fluid conduit can be fluidly connected to an annular channel within the mixer nozzle, the annular channel including an outlet from the mixer nozzle parallel to the primary axis disposed between the inner gas path and the outer gas path.

The outer gas path area can decrease in a downstream direction. The inner gas passage can include swirling gas passages directed towards the annular gap between the interior surface of the housing and the outer surface of the mixer nozzle.

The housing includes an inlet section, a mixing section, and an outlet section. A step can form a transition from the mixing section to the outlet section. The step being downstream of a gas inlet.

Three discrete struts can be attached to a surface of the mixer as supports within the housing. At least one of the struts can include the fluid conduit passing there through. The outer gas passage can be located between each of the discrete struts.

The mixer nozzle can be u-shaped, with an apex of the mixer nozzle directed towards an outlet of the housing. The mixer nozzle can include a cone with a rounded end facing downstream for eliminating recirculation zones. The housing can include a smooth widening section adjacent to the cone.

A separate fluid-gas mixer nozzle is also considered. The nozzle including a body circumscribing a primary axis, an inlet into an annular passage within the body for receiving fluid, and at least one passage through the body directed diagonally with respect to the primary axis for passing fluid through the body and an exit area which can control the pressure in the body and the velocity of the flow leaving the mixer. The annular passage can include an outlet adjacent to an outlet of the at least one passage. The body can include a cone directed away from the at least one passage. The body can include at least one supporting member with a fluid conduit therein configured for passing fluid to the inlet of the annular passage.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 1 is a perspective view of a fluid-gas mixer;

FIG. 2 is a partial sectional view of FIG. 1, showing internal components of the fluid-gas mixer;

DETAILED DESCRIPTION

Figure 3:
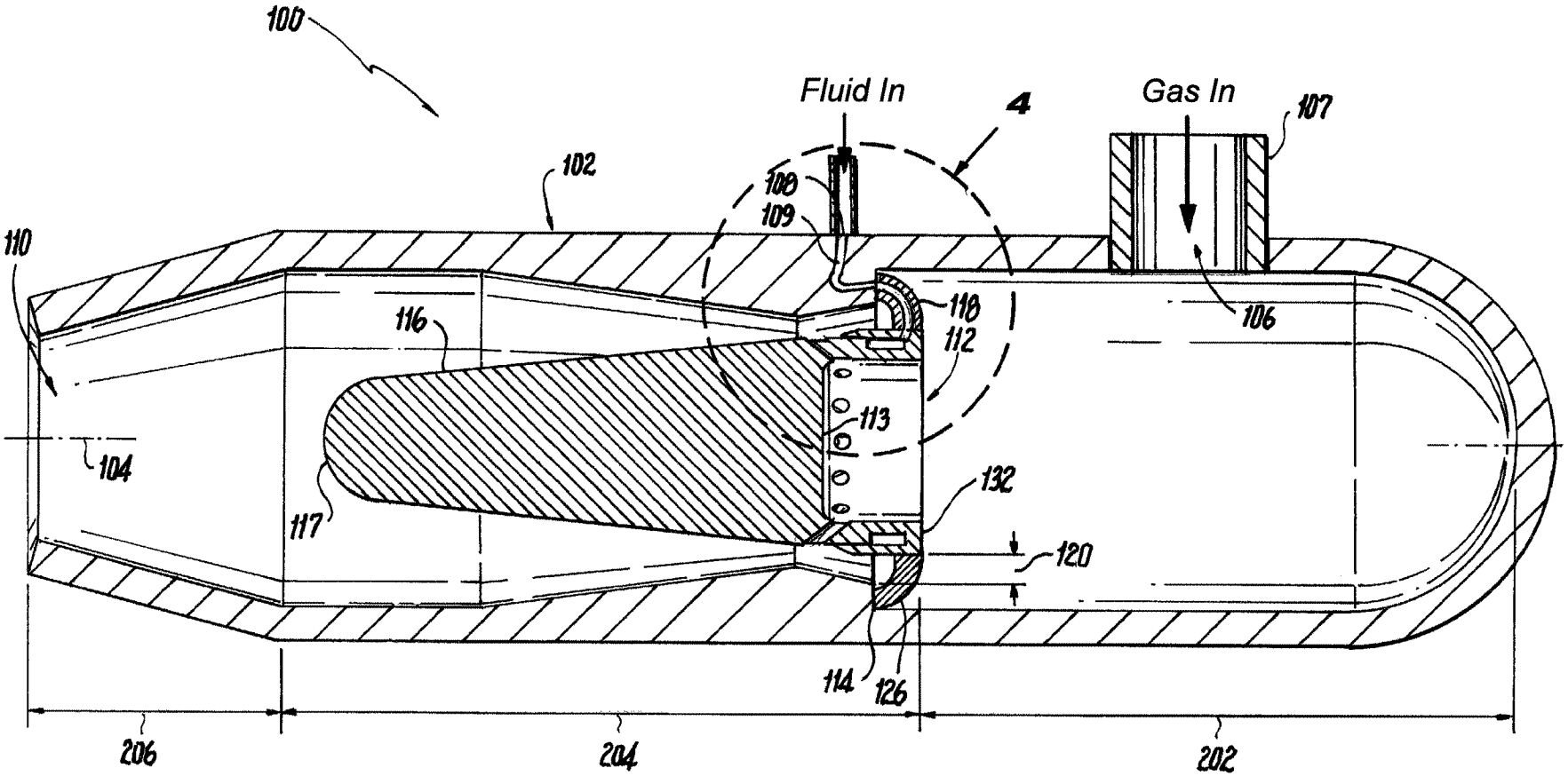
FIG. 3 is side sectional view of FIG. 1, showing the fluidic connections of the fluid-gas mixer.

Reference will now be made to the drawings wherein like reference numerals identify similar structural features or aspects of the subject invention. For purposes of explanation and illustration, and not limitation, a partial view of an exemplary embodiment of a fluid-gas mixer in accordance with the invention is shown in FIG. 1 and is designated generally by reference character 100. Other embodiments of the mixer in accordance with the invention, or aspects thereof, are provided in FIGS. 2-4, as will be described. The methods and systems of the invention can be used to improve aeration of fluids.

Referring to FIG. 1, a fluid-gas mixer 100 includes a housing 102, defining a primary axis 104, for mixing fluid and gas. Fluids intended for mixing include gaseous fuels (natural gas), as well as solid particles which have been fluidized such as flowing metal powder, and fluids such as liquid milk, liquid paint, water, oil, and various chemicals such as pesticides, herbicides. The housing 102 is elongated along the axis 104, and includes at least a pair of inlet conduits 107 108 for delivering the fluids to be mixed, and an outlet 110. A gas conduit 107 can be connected to the inlet 106 of the housing 102 for passing a gas to the housing. The gas can be air, oxygen, nitrogen, and other similar gasses.

Referring to FIGS. 2 and 3, a mixer nozzle 112 circumscribing the primary axis 104 is located within the housing 102 and a fluid conduit 108 is connected to the mixer nozzle 112 for introducing a fluid to the mixer nozzle 112. The housing 102 includes an inlet section 202, a mixing section 204, and an outlet section 206. A step 114 at the inner surface 124 of the housing 102 forms a transition from the inlet section 202 to the mixing section 204. The step 114 helps support the mixer nozzle 112. The mixer nozzle 112 is u-shaped, with an apex 113 of the mixer nozzle 112 directed towards an outlet of the housing. The mixer nozzle 112 includes a cone 116 directed towards the outlet 110 for controlling the recirculation of the mixed fluids. The cone includes a rounded end 117, in order to produce the required flow pattern. The mixer nozzle 112 can use at least one strut 118 to be fixed in position within the housing 102. Three struts 118 are the preferred, for supporting the mixer nozzle 112 in multiple directions. The housing 102 includes a smooth widening section adjacent to the cone 116 for ensuring proper flow of the mixed fluids. An annular gap 120 defines an outer gas path 126, the details of which are described below.

Figure 4:
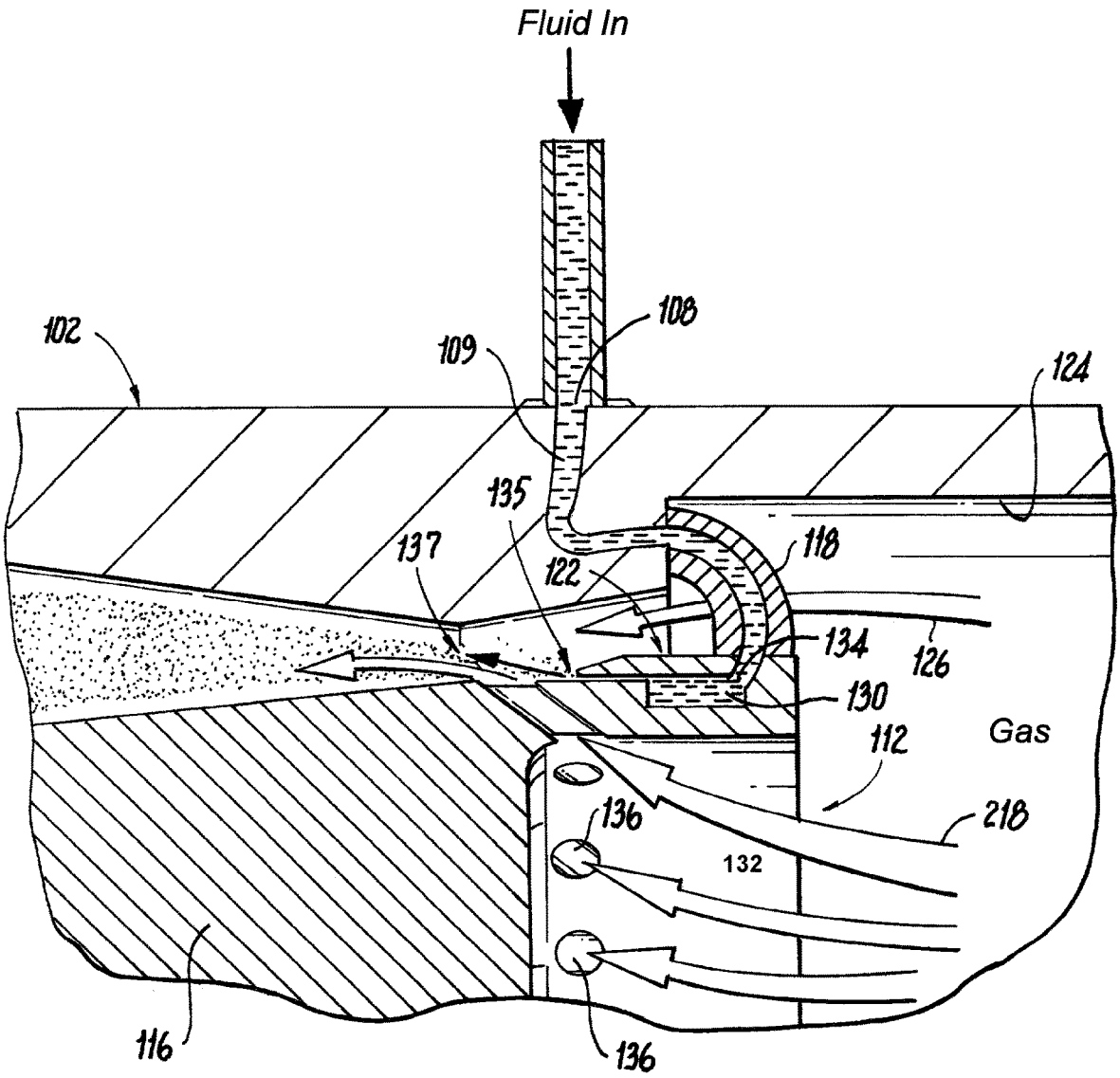
FIG. 4, is a sectional view of section 4 of FIG. 3, showing a detailed view of a mixing zone.

Referring to FIG. 4, the annular gap defined by an outer surface 122 of the mixer nozzle 112 and an inner surface 124 of the housing 102 defines at least one outer gas path 126. The outer gas path 126 narrows in the direction of flow. The outer gas path 126 is annular and can be subdivided into discrete sections by struts 118 attached to the inner surface 124 of the housing 102 and the outer surface 122 of the mixer nozzle 112. The struts 118 also provide support for the mixer nozzle 112 within the housing 102. The outer gas path 126 area decreases in a downstream direction. The outer gas path 126 can be narrowed by using the inner surface 124 of the housing 102. The decreasing or narrowing area helps maintain a necessary energy to mix the fluids. One of the struts 118 can include the fluid conduit 109 passing there through, The fluid conduit 109 can be a pipe or flexible line, or can be negative space within the strut 118.

Referring further to FIG. 4, the fluid conduit 109 is fluidly connected to an annular channel 130 within the mixer nozzle 112. The mixer nozzle includes a body 132 circumscribing the primary axis 104, an inlet 134 into the annular channel 130 within the body for receiving fluid, and at least one set of passages 136 directed radially and tangentially through the body 132 and circumferentially distributed with respect to the primary axis 104 and for passing fluid, specifically gas through the body 132. The annular channel 130 includes a fluid outlet 135 adjacent to an outlet 137 of the at least one set of gas passages 136. The at least one set of gas passages 136 can be a swirling gas passage defining an inner gas path 218 for injection of the gas and mixing with gasses coming through the outer gas path 126. The at least one gas passage 136 is also circumscribed around the primary axis 104. Each of the passages partially circumscribes the primary axis 104. It is also conceived that each of the passages can be fluidly connected to each other.

The mixer nozzle 112, divides the gas flow through either the outer gas path 126 or the inner passage 136. The mixer nozzle divides the gas flow into two streams both between 40% and 60% of the total flow but preferably close to 50% each. The inner stream, through the at least one gas passage 136 is preferably given a tangential or swirling flow component of angular momentum, this swirling creates an axial velocity disparity. The narrowing cross section of the outer gas path 126 forces the flow to intersect with the flow of the inner stream. The flow of fluid from the fluid outlet 135 forms an annular film of the fluid and outputs the fluid centrally between the two gas streams. This arrangement improves the mixing of the fluid and gas. The fluid outlet 135 is located between the inner and outer gas paths, and includes a larger diameter than the inner gas exit and at a smaller diameter than the outer gas exit. The outlet 110 provides further control of the operating pressure within the device and exit momentum of the flow.

The systems of the present disclosure, as described above and shown in the drawings, provide for a fluid mixing system with superior properties including increased reliability and reduced size, weight, complexity, and cost. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A fluid-gas mixer comprising:

a housing, defining a primary axis, for mixing fluid and gas;

a mixer nozzle circumscribing the primary axis, wherein an annular gap between an outer surface of the mixer nozzle and an inner surface of the housing defines at least one outer gas path;

an inner gas passage defining an inner gas path for mixing with the outer gas path; and a fluid conduit for supplying fluid to the mixer nozzle configured to mix with the inner gas path and the outer gas path.

2. The fluid mixer of claim 1, wherein the fluid conduit is fluidly connected to an annular channel within the mixer nozzle, the annular channel including an outlet from the mixer nozzle parallel to the primary axis disposed between the inner gas path and the outer gas path.

3. The fluid-gas mixer of claim 1, wherein the mixer nozzle is u-shaped, with an apex of the mixer nozzle directed towards an outlet of the housing.

4. The fluid-gas mixer of claim 1, wherein the outer gas path area narrows in a downstream direction.

5. The fluid gas mixer of claim 1, wherein the inner gas passage includes a swirling gas flow directed towards the annular gap between the interior surface of the housing and the outer surface of the mixer nozzle.

6. The fluid-gas mixer of claim 1, wherein the housing includes an inlet section, a mixing section, and an outlet section.

7. The fluid gas mixer of claim 6, wherein a step forms a transition from the inlet section to the mixing section.

8. The fluid gas mixer of claim 7, wherein the step is upstream of a gas outlet.

9. The fluid gas mixer of claim 1, wherein discrete struts attached to an inner surface of the housing support the mixer nozzle within the housing.

10. The fluid gas mixer of claim 9, wherein at least one of the struts includes the fluid conduit passing there through.

11. The fluid-gas mixer of claim 1, wherein the mixer nozzle includes a cone facing downstream for controlling recirculation zones.

12. The fluid gas mixer of claim 11, wherein the housing includes a smooth widening section adjacent to the cone.

13. The fluid gas mixer of claim 11, wherein the cone includes a rounded end.

* * * * *